US005567123A

United States Patent [19]

Childress et al.

[11] Patent Number: 5,567,123

[45] Date of Patent: Oct. 22, 1996

[54] PUMP DISPLACEMENT CONTROL FOR A VARIABLE DISPLACEMENT PUMP

[75] Inventors: Dale B. Childress, Plainfield, Ill.; Noah D. Manring, Roland, Iowa

[73] Assignee: Caterpillar Inc., Peoria, Ill.

[21] Appl. No.: 526,830

[22] Filed: Sep. 12, 1995

[51] Int. Cl.[6] ..... F04B 49/08

[52] U.S. Cl. ..... 417/222.1

[58] Field of Search ..... 417/218, 222.1, 417/222.2, 213; 60/445, 452

[56] References Cited

U.S. PATENT DOCUMENTS

| | | | |
|---|---|---|---|
| 4,245,962 | 1/1981 | Uehara et al. | 417/218 |
| 4,498,847 | 2/1985 | Akiyama | 417/222.1 |
| 4,599,050 | 7/1986 | Ishizaki et al. | 417/216 |
| 4,600,364 | 7/1986 | Nakatani et al. | 417/218 |
| 4,637,781 | 1/1987 | Akiyama et al. | 417/218 |

*Primary Examiner*—Timothy S. Thorpe

*Assistant Examiner*—Peter G. Korytnyk

*Attorney, Agent, or Firm*—John W. Grant

[57] ABSTRACT

A pump displacement control for a variable displacement pump includes a torque control valve disposed between a variable torque limiter and a force applying device disposed in axial alignment within a common bore. A sleeve and a valve spool are movable relative to each other to establish a first condition communicating discharge pressure into an actuator chamber to move a swashplate toward a minimum displacement position against the bias of a spring or a second condition communicating the actuating chamber with an exhaust passage to allow the spring to move the swashplate toward its maximum displacement position. A torque control piston disposed between opposing springs resiliently bias the valve spool in a direction to establish the second condition when control fluid is directed into a control chamber. Pump discharge pressure communicated into a pressure chamber exerts a force against the valve spool proportional to the discharge pressure so that the valve spool moves in a second direction to establish the first condition when the control force exceeds the biasing force exerted by the torque limiter.

20 Claims, 2 Drawing Sheets

10
13
23
26
27
29
34
39
46
48
49
52
54
56
58
60
66
68
71
74
77
78
79
81
82
83
21

PUMP DISPLACEMENT CONTROL FOR A VARIABLE DISPLACEMENT PUMP

TECHNICAL FIELD

This invention relates generally to a variable displacement pump and, more particularly, to a pump displacement control therefor having a servo valve mechanism and a variable torque limiter disposed within a common bore.

BACKGROUND ART

Variable displacement pumps require various types of displacement controls dependent upon the usage of the pump. High pressure feedback is almost always a requirement for any variable displacement control. For hydromechanical controls, this feedback is used to actuate a spring loaded spool in either a horsepower or torque limiting control, a high pressure cutoff control, or a load sensing control. Quite often, these controls utilize multiple forms of feedback to perform multiple control functions. When this is the case, the pump controls become very complicated in their design and are often characterized by large hardware configurations. Such large pump controls generally add to the overall cost of the pump.

Moreover, the torque limiting control commonly includes a torque control valve movable to an operating position for causing the swashplate to move toward a minimum displacement position when the discharge pressure exceeds a predetermined high pressure level. The torque control valve is moved toward the operating position by a feedback piston disposed within an actuating chamber having pump discharge pressure directed thereto. One or more springs are disposed to resist movement of the torque control valve to the operating position to establish the torque level setting. A problem encountered therewith is that when the power source driving the pump is shut down, the spring or springs bias the torque control valve to a position causing the swashplate to move to its maximum displacement position. This adds a considerable amount of extra torque to the power source that must be overcome by the starter to get the power source up to start-up speed when the power source is being started.

Finally, the maximum and minimum displacement settings of the swashplate are often established by contact between the swashplate and mechanical stops. This creates a hard stop which generates excessive noise.

The present invention is directed to overcoming one or more of the problems as set forth above.

SUMMARY OF THE INVENTION

In one aspect of the present invention, a pump displacement control is provided for a variable displacement pump having a swash plate and a servo actuator for moving the swash plate between maximum and minimum displacement positions. The servo actuator includes a servo piston operatively connected to the swash plate, a means for biasing the swash plate toward its maximum displacement position, and an actuator chamber at one end of the piston for controllably receiving a control pressure to move the swash plate toward its minimum displacement position. The pump displacement control comprises a body having a bore therein, a discharge passage communicating discharge pressure to the bore, a control passage communicating the bore with the actuator chamber, and an exhaust passage connected with the bore. A torque control valve is disposed within the bore for controlling fluid flow into and out of the actuator chamber and includes a sleeve slidably disposed within the bore and operatively mechanically coupled to the piston, and a valve spool slidably disposed within the sleeve, the valve spool and the sleeve being movable relative to each other to establish a first condition communicating the discharge passage with the control passage and a second condition communicating the control passage with the exhaust passage. A variable torque limiter is disposed within the bore in axial alignment with the torque control valve for applying a remotely controllable variable resilient force biasing the valve spool in a first direction to establish the second condition. A means is provided for applying a control force against the valve spool proportional to the discharge pressure of the variable displacement pump so that the valve spool moves in a second direction to establish the first condition when the control force exceeds the biasing force exerted by the torque limiter.

BEST MODE FOR CARRYING OUT THE INVENTION

Figure 1:
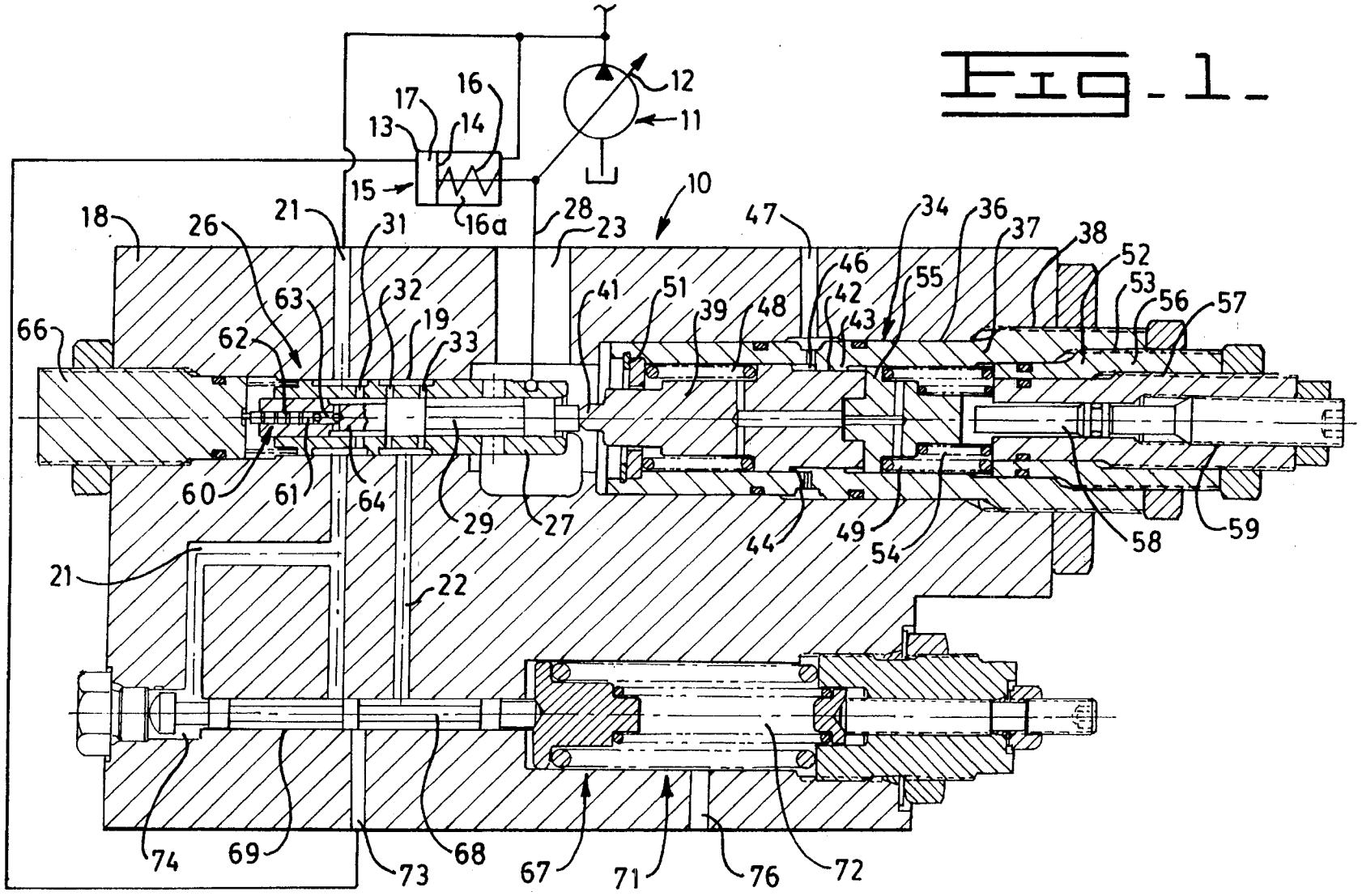
FIG. 1 is a diagrammatic sectional view illustrating an embodiment of the present invention.

Referring now to the drawings, a pump displacement control generally indicated by the reference numeral 10 is shown in combination with a variable displacement pump 11 having a swash plate 12 movable between maximum and minimum displacement positions. A servo actuator diagrammatically shown at 13 includes a servo piston 14 operatively connected to the swash plate 12, a means 15 for biasing the swash plate toward its maximum displacement position, and an actuator chamber 17 at one end of the piston for controllably receiving a control pressure to move the swash plate toward its minimum displacement position. The means 15 can be for example a compression spring 16 and a chamber 16a connected to pump discharge. While the pump displacement control and the servo actuator are shown separated from the variable displacement pump for illustrative convenience, these components are generally contained within or secured to the housing of the variable displacement pump.

The pump displacement control 10 includes a body 18 having a bore 19 therein, a discharge passage 21 communicating pump discharge pressure to the bore, a control passage 22 communicating the bore with the actuator chamber 17, and an exhaust passage 23 communicating with the bore.

A torque control valve 26 is disposed within the bore 19 for controlling fluid flow into and out of the actuator chamber 17. The torque control valve includes a sleeve 27 slidably disposed within the bore 19 and a valve spool 29 slidably disposed within the sleeve. The sleeve is operatively mechanically coupled to the piston 14 through a connecting member 28 for moving the sleeve proportional to displacement of the swash plate. The valve spool and the sleeve are movable relative to each other to establish a first condition communicating the discharge passage 21 with the control passage 22 through annular ports 31,32 in the sleeve while blocking the control passage 22 from the exhaust passage 23 by blocking a pair of ports 33 in the sleeve. The valve spool and the sleeve also establish a second condition communicating the control passage 22 with the exhaust passage 23 through the ports 33 while blocking communication between the discharge passage 21 and the control passage 22 by blocking fluid flow through the ports 31. A neutral condition established by the valve spool and the sleeve blocks the discharge, control, and exhaust passages from each other.

A variable torque limiter 34 is disposed within an enlarged section 36 of the bore 19 in axial alignment with the torque control valve 26 for applying a remotely controllably variable resilient force biasing the valve spool 29 leftward in a first direction to establish the second condition. The torque limit in this embodiment is a cartridge type configuration contained within a tubular housing 37 positioned within the enlarged section 36 and connected to the body 18 through a threaded connection 38. A piston 39 is slidably disposed within the tubular housing 37 and has a nose 41 in abutment with the valve spool 29. The piston includes a reduced diameter portion 42 slidably disposed within a radially inwardly extending land 43 and terminates at an annular reaction surface 44 for defining a control chamber 46. The control chamber 46 continuously communicates with an inlet control port 47. The piston is positioned between a pair of opposed compression springs 48,49 which are maintained in a preloaded condition by a spring retainer 51 suitably secured to the tubular housing and a tubular spring force adjustment member 52 adjustably secured to the tubular housing through a threaded connection 53. A spring seat 55 is disposed between the piston and the spring 49. A bumper spring 54 is disposed between the spring seat 55 and another tubular spring force adjustment member 56 adjustably connected to the adjustment member 52 through a threaded connection 57. The spring 48 biases piston 39 and hence the valve spool leftward in the first direction while the spring 49 resists leftward movement of the piston 39 and hence the valve spool.

A means is provided for hydraulically stopping movement of the swash plate 12 toward the minimum displacement position and includes a minimum hydraulic flow stop 58 extending through and adjustably connected to the adjustment member 56 through a threaded connection 59.

A means 60 is provided for applying a force against the valve spool 29 proportional to the discharge pressure of the variable displacement pump so that the valve spool moves rightward in a second direction relatively to the sleeve 27 to establish the first condition when the control force exceeds the biasing force exerted by the torque limiter 34. The means 60 can include, for example, a piston or slug 61 slidably disposed within a bore 62 in the valve spool 29 defining a pressure chamber 63 continuously communicating with the discharge passage 21 through the ports 31 and a pair of ports 64 in the valve spool. The slug 61 abuts against a stop 66 adjustably threadably secured within an open end of the bore 19. As will hereinafter be described, the stop 66 serves as a means for hydraulically stopping movement of the swash plate toward the maximum displacement position.

A load sensing control mechanism 67 includes a valve spool 68 slidably disposed within a bore 69 and resiliently biased to the position shown by a spring mechanism 71 disposed within a load sense chamber 72. At the position shown, the valve spool 68 establishes communication between the control passage 22 and a control port 73 communicating with the actuator chamber 17. The valve spool is movable rightward to a position blocking communication between the control passage 22 and the control port 73 and communicating the discharge passage 21 with the control port 73. A chamber 74 defined at the left end of the valve spool continuously communicates with the discharge passage 21. A load sensing port 76 communicates with the load sensing chamber 72.

Figure 2:
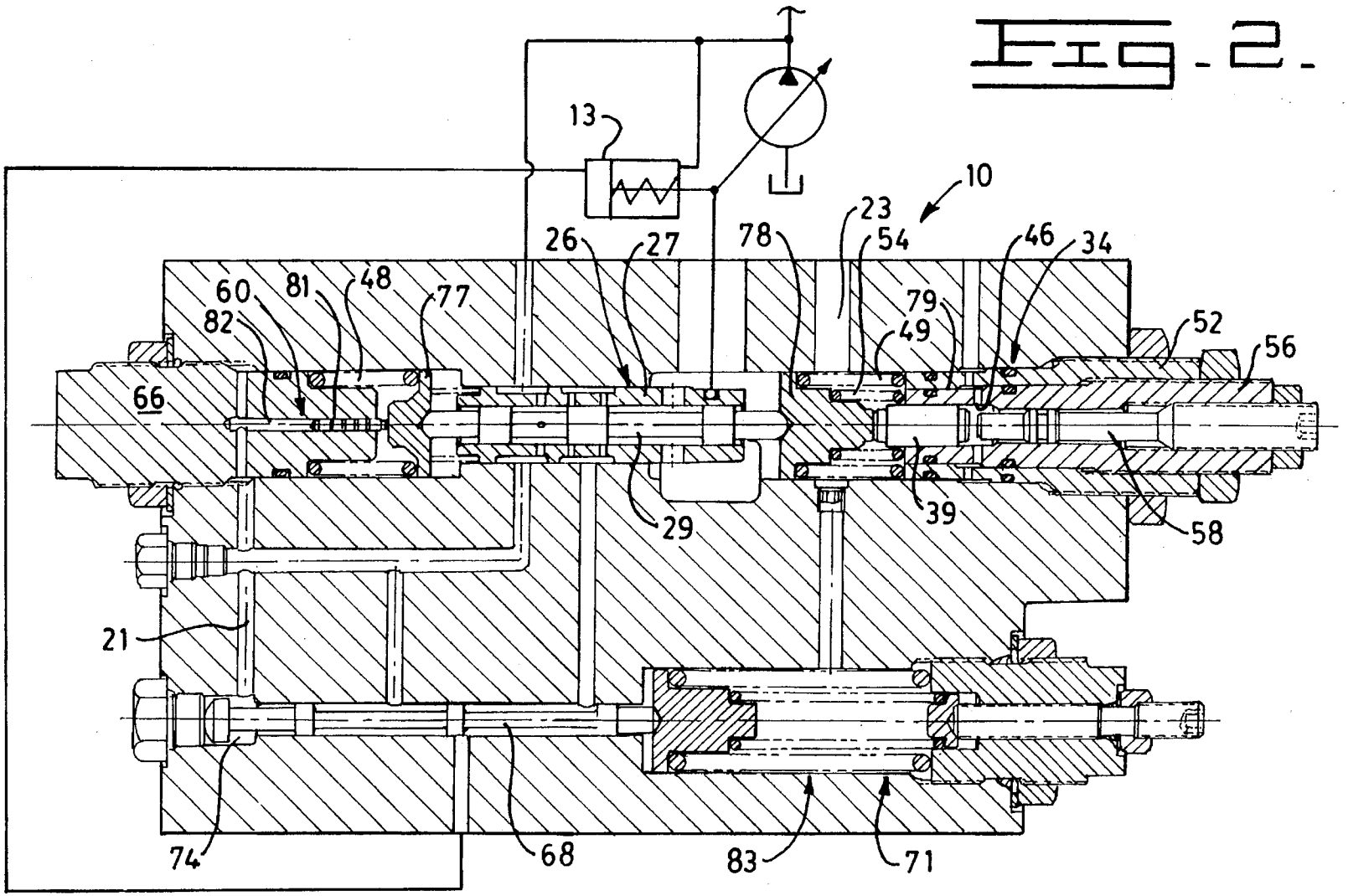
FIG. 2 is a diagrammatic sectional view of another embodiment of the present invention.

An alternate embodiment of the pump displacement control 10 of the present invention is disclosed in FIG. 2. It is noted that the same reference numerals of the first embodiment are used to designate similarly constructed counterpart elements of this embodiment. In this embodiment, however, the springs 49 and 54 of the variable torque limiter 34 are disposed between the force adjustment members 52 and 56 and a spring seat 78 abutting the right end of the valve spool 29 so that the spring 49 biases the valve spool 29 leftward. The spring 48 is disposed between the stop member 66 and a spring seat 77 abutting the left end of the valve spool 29 to resist leftward movement of the valve spool. The piston 39 abuts the spring seat 78 and is slidably disposed within a bore 79 of the adjustment member 56 defining the control chamber 46.

The force applying means 60 includes a piston 81 abutting the spring seat 77 and slidably disposed within a bore 82 continuously communicating with a discharge passage 21.

Finally, the load sensing control 67 described in conjunction with FIG. 1 has been converted to a high pressure cutoff 83 by eliminating the load sense port 76 and communicating the chamber 72 with the exhaust passage 23. The preload on the spring mechanism 71 has also been increased accordingly.

Industrial Applicability

The pump displacement control 10 of FIG. 1 is commonly incorporated within a variable displacement pump used with a closed center hydraulic system while the pump displacement control 10 FIG. 2 is commonly incorporated within a variable displacement pump used with an open center hydraulic system. Referring specifically to the embodiment of FIG. 1, the displacement of the pump 11 and thus the flow rate and discharge pressure is controlled by either the torque control valve 26 or the load sensing mechanism 67 dependant upon the pressure and/or flow rate demanded by a hydraulic system connected to the pump. If the pressure is below a predetermined high level for a given flow, displacement is essentially controlled by the load sensing mechanism. When the pressure exceeds the high predetermined level, the torque control valve 26 assumes control of the pump displacement.

The valve spool 29 and the sleeve 27 are shown at the neutral condition at which the actuator chamber 17 is blocked from both the discharge and exhaust passages 21 and 23. This is a default position established by the opposing forces of the springs 48 and 49 when no pressure is present in the control chamber 46 such as when the power source driving the pump is shut down. At this default position, the swash plate 12 moves to a mid-displacement position.

In use, once the power source is started and a control pressure signal is directed into the control chamber 46, the piston 39 moves leftward biasing the valve spool leftward to establish the second condition of the sleeve and valve spool communicating the control passage 22 with the exhaust passage 23. Normally, this causes the swash plate to move toward the maximum displacement position. However, discharge pressure generated by the pump starts to increase. When the discharge pressure reaches a predetermined low level, the discharge pressure in the chamber 74 moves the valve spool 68 rightward to communicate control pressure into the actuator chamber 17. This moves the swash plate toward the minimum displacement position against the bias of the spring 16. If no load pressure from the hydraulic system is present in the actuating chamber 72, only the spring mechanism 71 resists rightward movement of the valve spool 68. Thus, the predetermined low level of discharge pressure is established by the preload of the spring mechanism 71.

When a control valve of the hydraulic system is thus opened for directing fluid to a hydraulic cylinder, one of two different actions normally takes place. If resistance to movement of the hydraulic cylinder is sufficiently low, the level of the discharge pressure in the discharge passage 21 and thus the control chamber 74 decreases. This allows the valve spool 68 to move leftward to communicate the actuator chamber 17 with the exhaust passage permitting the spring 16 and discharge pressure in the spring chamber 16*a* to move the swash plate toward the maximum displacement position. Once the flow rate demanded by the system is satisfied, the valve spool 68 will move to a position to maintain the swash plate at a displacement setting as determined by the opposing forces acting on the spool 68.

In some operational situations, the flow rate demanded by the system can be greater than the maximum output of the pump. Under those conditions, movement of the swash plate 12 and thus leftward movement of the sleeve 27 will continue until the sleeve reaches a position establishing the neutral condition of the sleeve and the valve spool 29 wherein the discharge, control and exhaust passages 21, 22 and 23 are blocked from each other. This stops movement of the swash plate toward maximum displacement before it contacts the mechanical stop, not shown, and thereby hydraulically establishes the maximum displacement flow setting of the swash plate. The maximum displacement setting can be adjusted by axial adjustment of the stop member 66.

Conversely, if an external force is resisting movement of the hydraulic cylinder so that a load pressure is generated and transmitted into the chamber 72, an additional force is exerted against the valve spool 68 by the load pressure urging it leftward against the force exerted on the valve spool 68 by the discharge pressure in the control chamber 74 to communicate the actuator chamber 17 with the exhaust passage 23 to increase pump displacement and thus the discharge pressure. Once the discharge pressure reaches a predetermined level greater than the load pressure, the valve spool 68 will move to a position to maintain the swash plate at a position determined by the opposing forces acting on the spool 68.

Should the demand for fluid reach a level such that the discharge pressure exceeds the high predetermined level, the force exerted on the valve spool 29 by the discharge pressure in the control chamber 63 becomes sufficient to move the valve spool 29 rightward against the bias of the torque limiter 34 to establish the second condition of the valve spool and sleeve 22. This blocks communication between the control passage 22 and the exhaust passage 23 and communicates a control pressure through the control port 73 to the actuator chamber 17 causing the swash plate to move toward the minimum displacement setting for reducing the torque output of the pump. In extreme situations, rightward movement of the valve spool 29 will continue until the spring seat contacts the minimum stop member 58 and the sleeve 27 reaches a position establishing the neutral condition blocking the discharge, control and exhaust passages from each other. This stops movement of the swash plate toward minimum displacement before it contacts the mechanical stop, not shown, and thereby hydraulically establishes the minimum displacement flow setting of the swash plate. The minimum displacement setting can be adjusted by axial adjustment of the stop member 58. The fluid flow path feeding discharge fluid into and out of the control chamber provides a good anti-silting characteristics to minimize the tendency for the slug to stick.

The predetermined high level at which the swash plate starts to move toward the minimum displacement setting can be varied by changing the level of the control fluid pressure in the control chamber 46 by any well known manner. Increasing the pressure in the control chamber 46 raises the predetermined high level while decreasing the pressure lowers the predetermined high level. The bumper spring 54 functions in cooperation with the spring 49 to approximate a constant torque curve.

Referring now to the embodiment of FIG. 2, the torque control valve 26 and variable torque limiter 34 function essentially as described above in regard to the embodiment of FIG. 1 except that the swash plate 12 will move essentially to its maximum position immediately upon start-up of the pump if the control valves of the open center system are in their neutral open center positions. Another difference is that the spring mechanism 71 of the high pressure cutoff control 83 maintains the valve spool 68 in the position shown until the discharge pressure reaches a very high cutoff pressure which is typically set slightly below the maximum system pressure determined by a relief valve not shown. When the cutoff pressure is reached, the valve spool 68 is urged rightward to initially block the actuator chamber 17 from the exhaust port 23 and subsequently communicates discharge pressure to the actuator chamber 17 for reducing the displacement of the pump 11 to a minimum displacement setting while the discharge pressure is at a maximum level.

Other aspects, objects and advantages of this invention can be obtained from a study of the drawings, the disclosure and the appended claims.

We claim:

1. A pump displacement control for a variable displacement pump having a swash plate movable between maximum and minimum displacement positions and a servo actuator including a servo piston operatively connected to the swash plate, a means for biasing the swash plate toward its maximum displacement position, and an actuator chamber at one end of the piston for controllably receiving a control pressure to move the swash plate toward its minimum displacement position, comprising:

a body having a bore therein, a discharge passage communicating discharge pressure to the bore, a control passage communicating the bore with the actuator chamber, and an exhaust passage communicating with the bore;

a torque control valve disposed within the bore for controlling fluid flow into and out of the actuator chamber and including a sleeve slidably disposed within the bore and operatively mechanically coupled to the piston, and a valve spool slidably disposed within the sleeve, the valve spool and the sleeve being movable relative to each other to establish a first condition communicating the second condition communicating the control passage with the exhaust passage;

a variable torque limiter disposed within the bore in axial alignment with the torque control valve for applying a remotely controllable variable resilient force biasing the valve spool in a first direction to establish the second condition; and means for applying a Control force against the valve spool proportional to the discharge pressure of the variable displacement pump so that the valve spool moves in a second direction to establish the first condition when the control force exceeds the biasing force exerted by the torque limiter.

2. The pump displacement control of claim 1 wherein the torque limiter includes a first spring disposed to bias the spool in the first direction and a second spring disposed to oppose the biasing force of the first spring.

3. The pump displacement control of claim 2 wherein the opposing force exerted by the second spring increases and the biasing force exerted on the spool by the first spring decreases as the spool moves in the first direction.

4. The pump displacement control of claim 2 wherein the torque limiter includes a piston and a torque control chamber defined in part by the piston, the piston being disposed to controllably exert a force biasing the spool in the first direction when control fluid is directed to the torque control chamber.

5. The pump displacement control of claim 4 wherein the valve spool and the sleeve are movable to establish a neutral condition blocking the control passage from the exhaust passage and including means for hydraulically stopping movement of the swash plate toward the minimum displacement position, the means including a minimum displacement stop positioned to stop movement of the piston and thus movement of the valve spool in the second direction at a predetermined position to establish the neutral condition of valve spool and the sleeve.

6. The pump displacement control of claim 5 including a spring force adjustment member having an end in contact with the second spring and being axially adjustable relative to the body.

7. The pump displacement control of claim 6 wherein the minimum displacement stop is adjustably coaxially disposed relative to the spring force adjustment member.

8. The pump displacement control of claim 7 wherein the torque limiter includes a tubular housing disposed within the bore and having a threaded portion threadably receiving the spring force adjustment member, and a spring retainer secured to the tubular housing, the first spring, the piston and the second spring being axially disposed within the tubular housing between the spring retainer and the spring force adjustment member.

9. The pump displacement control of claim 7 wherein the tubular housing has an inwardly extending land and the piston has an annular reaction surface cooperating with the land to define the torque control chamber.

10. The pump displacement control of claim 4 wherein the valve spool and the sleeve are movable to establish a neutral condition blocking the control passage from the exhaust passage and including means for hydraulically stopping movement of the swash plate toward the maximum displacement position, the means including a maximum displacement stop positioned to stop movement of the valve spool in the first direction at a predetermined position to establish the neutral condition of the valve spool and the sleeve.

11. The pump displacement control of claim 10 wherein the maximum displacement stop is adjustably disposed in axial alignment with the valve spool.

12. The pump displacement control of claim 10 wherein the control force applying means includes a bore in the valve spool of the torque control valve opening toward the maximum displacement stop, a slug slidably disposed within the bore in the valve spool of the torque control valve and having an end in abutment with the maximum displacement stop, and passage means for continuously communicating discharge pressure into the bore in the valve spool of the torque control valve.

13. The pump displacement control of claim 4 including a load sensing mechanism disposed within the control passage and including another bore defined in the body and communicating with the control passage, and a valve spool slidably disposed in the other bore for controlling communication between the actuator chamber and the control passage and between the discharge passage and the actuator chamber.

14. The pump displacement control of claim 13 wherein the load sensing mechanism includes a chamber at one end of the valve spool of the load sensing mechanism and being in continuous communication with the discharge passage, a load sense chamber defined in the body, a spring mechanism disposed within the load sense chamber for resisting movement of the valve spool of the load sensing mechanism in the first direction, and an input port communicating with the load sense chamber.

15. The pump displacement control of claim 4 including a high pressure cutoff disposed within the control passage and including another bore defined in the body and communicating with the control passage, and a valve spool slidably disposed in the other bore for controlling communication between the actuator chamber and the control passage and between the discharge passage and the actuator chamber.

16. The pump displacement control of claim 15 wherein the high pressure cutoff includes a chamber at one end of the valve spool of the load sensing mechanism and being in continuous communication with the discharge passage, a spring chamber defined in the body and communicating with the exhaust passage, and a spring mechanism disposed within the spring chamber for resisting movement of the valve spool of the high pressure cutoff in the first direction.

17. The pump displacement control of claim 8 including a first spring seat disposed between the first spring and one end of the valve spool and a second spring seat in abutment with the other end of the valve spool, the second spring being disposed between the maximum displacement stop and the second spring seat.

18. The pump displacement control of claim 17 including another tubular spring force adjustment member adjustably disposed within the spring force adjustment member and having a bore therein, a bumper spring disposed between the other spring force adjustment member and the first spring seat, the piston being slidably disposed within the bore in the other spring force adjustment member and being in abutment with the first spring seat.

19. The pump displacement control of claim 18 wherein the minimum displacement stop is adjustably disposed within the other force adjustment member.

20. The pump displacement control of claim 19 wherein the control force applying means includes a bore defined in the maximum displacement stop and being in continuous communication with the discharge passage, and a piston slidably disposed in the bore in the maximum displacement stop and abutting the second spring seat.

* * * * *

UNITED STATES PATENT AND TRADEMARK OFFICE

CERTIFICATE OF CORRECTION

PATENT NO. : 5,567,123

DATED : October 22, 1996

INVENTOR(S) : Childress et al.

It is certified that error appears in the above-identified patent and that said Letters Patent is hereby corrected as shown below:

Claim 1, column 6, line 59, after "communicating the , insert --discharge passage with the control passage and a--

Claim 1, column 6, line 66, replace "Control" with --control--.

Signed and Sealed this

Seventh Day of January, 1997

*Attest:*

Bruce Lehman

BRUCE LEHMAN

*Attesting Officer*

*Commissioner of Patents and Trademarks*